US005676589A

United States Patent [19]

Ashworth

[11] Patent Number: 5,676,589

[45] Date of Patent: Oct. 14, 1997

[54] BLAST APPARATUS

[75] Inventor: Terence Ives Ashworth, Guernsey, Channel Islands

[73] Assignee: Vapormatt Limited, Guernsey, Channel Islands

[21] Appl. No.: 668,240

[22] Filed: Jun. 21, 1996

[30] Foreign Application Priority Data

Jun. 24, 1995 [GB] United Kingdom ..... 9512923

[51] Int. Cl.[6] ..... B24B 31/00

[52] U.S. Cl. ..... 451/102; 451/101

[58] Field of Search ..... 451/90, 91, 98, 451/99, 100, 101, 102; 239/549, 554, 567

[56] References Cited

U.S. PATENT DOCUMENTS

| | | | |
|---|---|---|---|
| 990,409 | 4/1911 | Walsh | 451/102 |
| 2,701,738 | 2/1955 | Cerasi | 239/554 |
| 2,726,072 | 12/1955 | Hermann | 239/554 |
| 2,869,290 | 1/1959 | Stokes | 451/102 |
| 3,109,262 | 11/1963 | Weaver et al. | 451/102 |
| 3,137,974 | 6/1964 | Kirkland | 451/102 |
| 3,344,558 | 10/1967 | Kirkland | 451/102 |
| 3,972,150 | 8/1976 | Hart | 451/90 |
| 4,307,842 | 12/1981 | Morris | 239/567 |
| 4,704,826 | 11/1987 | Kirkland | 451/102 |
| 4,819,388 | 4/1989 | Kirkland | 451/102 |
| 5,536,200 | 7/1996 | Kiess | 451/102 |
| 5,558,562 | 9/1996 | Diat | 451/101 |

*Primary Examiner*—James G. Smith
*Assistant Examiner*—Derris H. Banks
*Attorney, Agent, or Firm*—Notaro & Michalos Pc

[57] ABSTRACT

With reference to FIG. 1, a blast gun assembly 1 of cylindrical form comprises a plurality of disc-shaped body sections 2, 3, 5 and 10, clamped together in face-to-fact contact. The body sections 2 comprise head sections and carry air/slurry mixture discharge nozzles 14. Each pair of adjacent body sections 2 is separated by a spacer section 3. Sections 2, 3 are formed with internal holes which are aligned to form internal ducts, connected to a slurry inlet 6 and an outlet 7, an air blast 8, and water rinse/air dry supplies 9. Water rinse and/or drying air is discharged from the assembly 1 by nozzles 26.

17 Claims, 4 Drawing Sheets

BLAST APPARATUS

This invention relates to blast apparatus.

BACKGROUND TO THE PRESENT INVENTION

The invention is concerned with blast guns for discharging a mixture of abrasive material and fluid, for example air, whereby surfaces may be polished, scoured or mechanically plated. As used herein the term 'abrasive material' includes slurries.

In our patent specification No. 2065514 B we have disclosed a blast gun comprising a body having an internal mixing chamber, a discharge nozzle, and internal passageways for introducing into the mixing chamber separate flows of air and water from tubular inlets which are connected in use to supply hoses. When a series of discharge nozzles are required several of these blast guns can be mounted alongside one another, but a problem with such an assembly of blast guns is that there is a large number of external hoses which all need to be connected separately to the air and water supplies.

SUMMARY OF THE PRESENT INVENTION

According to the present invention a blast gun assembly comprises a plurality of body sections which are clamped in face to face contact with one another, at least some of the body sections being in the form of head sections carrying respective discharge nozzles, the sections being formed with duct means for supplying in use the nozzles with separate flows of abrasive material and the duct means extending through the mating faces of the adjacent sections to provide communication between the sections.

The provision of duct means communicating with the adjacent body section avoids the need for each discharge nozzle to be provided with individual hose connections.

Preferably each head section comprises an internal mixing chamber and passageways for introducing separate flows of the abrasive material and fluid into a common end of the said mixing chamber.

The blast gun assembly may comprise an alternating arrangement of head sections carrying discharge nozzles being separated by sections without discharge nozzles acting as spacer sections.

Preferably an end section comprises duct means for the transportation of abrasive material and fluids between the separate duct means of one head section.

Preferably the duct means comprises circular holes with axes of which are perpendicular to a flat plane of the section.

Preferably the blast gun assembly is provided with a supply connection and a return connection for the abrasive material.

Preferably for at least some of the head sections the common axis of the circular holes used for conveying the abrasive material to the mixing chamber is in alignment with the axis of the supply connection. Also preferably for at least some of the head sections the common axis of the circular holes used for introducing the abrasive material is in alignment with the axis of the return connection.

The provision of the abrasive material being conveyed from the supply connection and the return connection provides a consistent supply of abrasive material and fluid to each nozzle whereby a uniformity of blasting results.

Preferably the blast gun assembly comprises an air supply connection.

Preferably the blast gun assembly is provided with at least one fluid rinse supply connection. Also preferably the blast gun assembly is provided with at least one air drying supply connection.

Preferably the head sections comprise fluid rinse nozzles.

Preferably the head sections comprise air drying nozzles.

Preferably the head section is made out of abrasive-resistant material. Also preferably the head section is made out of a resilient plastics material, e.g. a urethane elastomer.

Preferably the spacer section is made out of abrasive-resistant material.

Also preferably the spacer section is made out of a resilient plastics material, e.g. a urethane elastomer.

Preferably the blast gun assembly is made out of abrasive-resistant material.

Also preferably the blast gun assembly is made out of a resilient plastics material, e.g. a urethane elastomer.

BRIEF DESCRIPTION OF THE DRAWINGS

The various aspects of the invention will now be further described, by way of example only, with reference to the accompanying drawings wherein.

DETAILED DESCRIPTION OF THE PREFERRED EMBODIMENT

Figure 1:
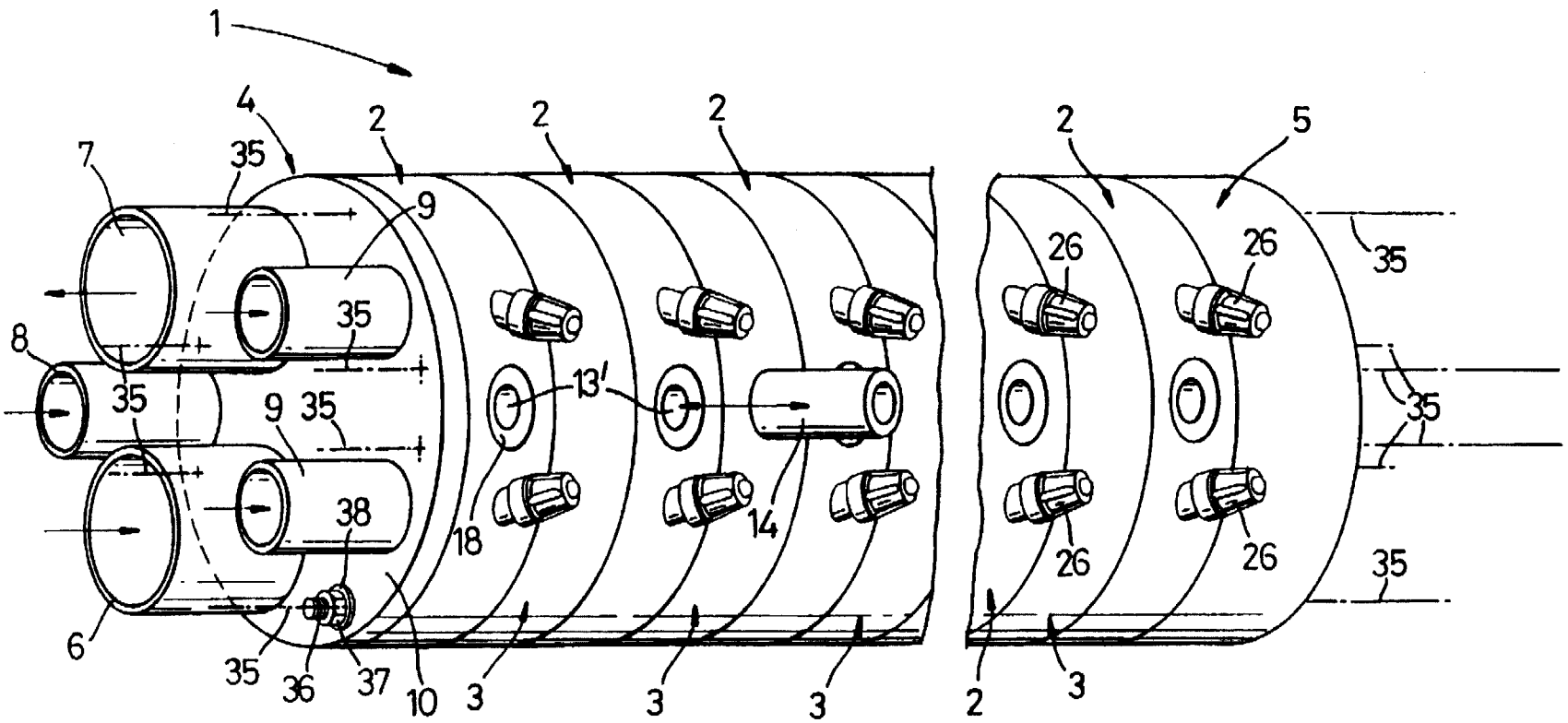
FIG. 1 is a schematic view of a blast gun assembly in accordance with the invention.

With reference to FIG. 1 a blast gun assembly 1 of cylindrical form is shown thereby. The assembly 1, which is for discharging a pressurised mixture of abrasive material (in slurry form) and air, and for discharging rinsing and/or drying fluid, comprises a plurality of identical head sections 2 and identical spacer sections 3, a supply end section 4 and a return end section 5, all held together, by tie rods 36, in face to face engagement.

The supply end section 4 comprises a plate 10 having substantially flat inner and outer faces. Projecting from the outer face of section 4 is a tubular slurry supply connection 6, a tubular slurry return connection 7, a tubular blast air supply connection 8 and two tubular fluid rinse/air dry supply connections 9. Respective supply tubes are attached in use to the different connections 6 to 9. The connections 6 to 9 connect with ducts in the plate 10 in the form of circular holes having axes perpendicular to the plane of the plate 10.

Figure 2:
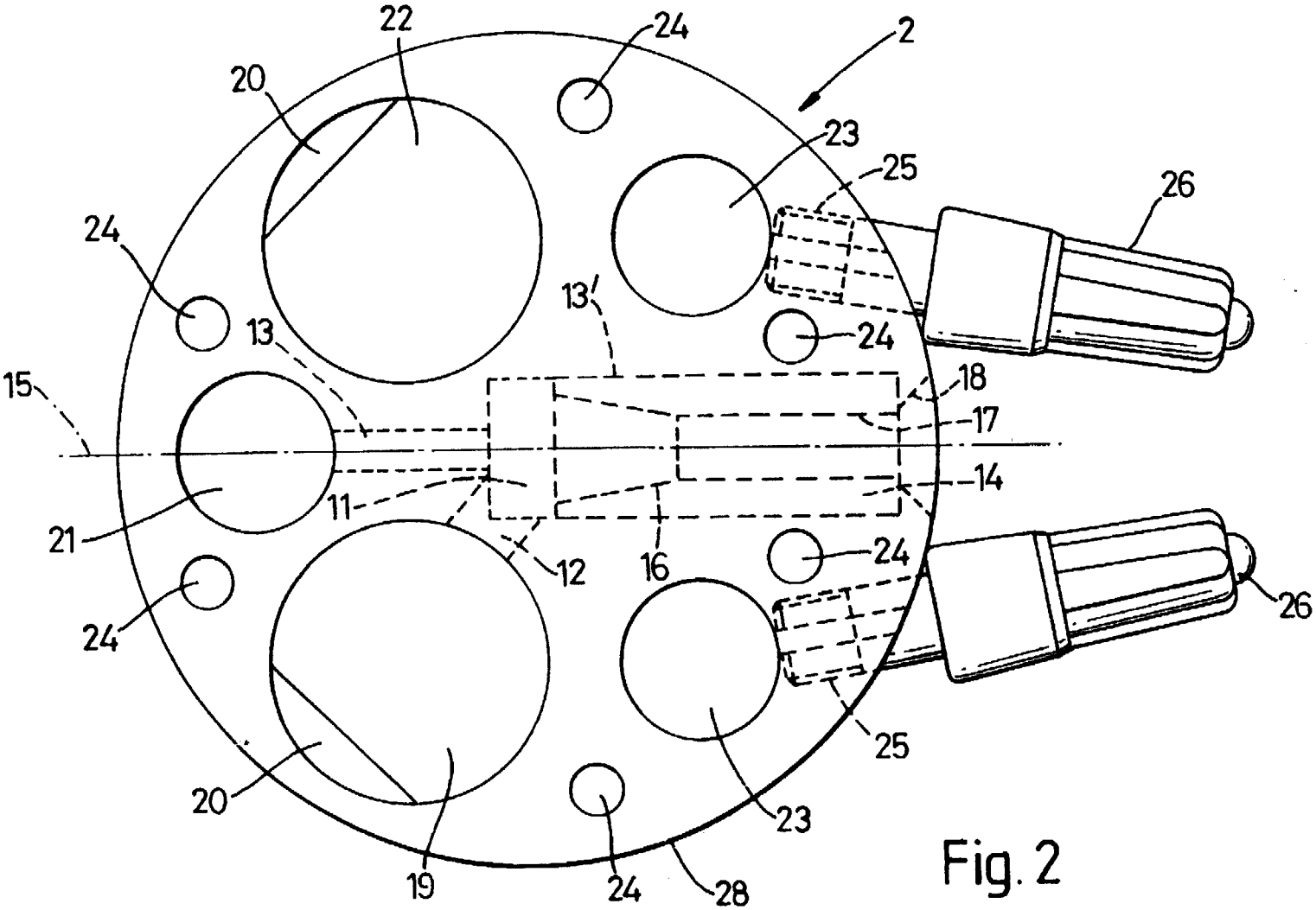
FIG. 2 is a side view on a larger scale of a head section of the assembly of FIG. 1.

FIG. 2 shows one of the head sections 2 comprising a circular disc 28 having substantially flat side faces, and formed with a radial bore $13^1$ the inner end of which provides a cylindrical mixing chamber 11, duct means comprising internal passageways 12 and 13 for introducing separate flows of an abrasive material and air into the mixing chamber 11, and a mixture discharge (blast) nozzle 14 demountably disposed within the outer part of bore $13^1$. The substantially flat side faces may have raised sections protruding from the surface. The said raised section may house resilient O-rings in abutment with the adjacent section, the O-rings surrounding the respective holes in the sections.

The passageway 13 is disposed in substantial alignment with an axis 15 of bore $13^1$. Passageway 12 is disposed at an angle to the axis 15 of approximately 60°.

Mixture discharge nozzle 14 is of tubular form and has a convergent entry portion 16 merging with a substantially parallel outlet portion 17. Such nozzles are as described in patent specification No. GB 2065514. The nozzle 14 is prevented from being blown out of the disc 28 by stop means comprising an abutment formed by an inwardly extending flange portion 18. The flange portion 18 defines a frusto-conical outlet orifice. The disc 2, being resilient and deformable, allows the nozzle 14 to be replaced, when necessary, by distortion of the disc 2, whereby a nozzle can be removed from or inserted, into bore 13[1].

The duct means also comprises a plurality of circular holes 19, 21, 22, 23 and 24 all of which have their axes perpendicular to the discos flat faces and extend through the full thickness of the disc 2.

Passageway 12 connects hole 19 with the mixing chamber 11. Projecting from the bore walls of holes 19 and 22 are sector-shaped baffles 20. The baffles 20 comprise structure operable to create fluid flow turbulence within the duct means formed by the aligned holes 19, 22.

Passageway 13 connects the hole 21 with the mixing chamber 11.

Protruding from the edge of the disc 28 are two nozzles 26. Internal passageway 25 connects holes 23 with nozzle 26 mounted symmetrically with respect to axis 15.

Figure 3:
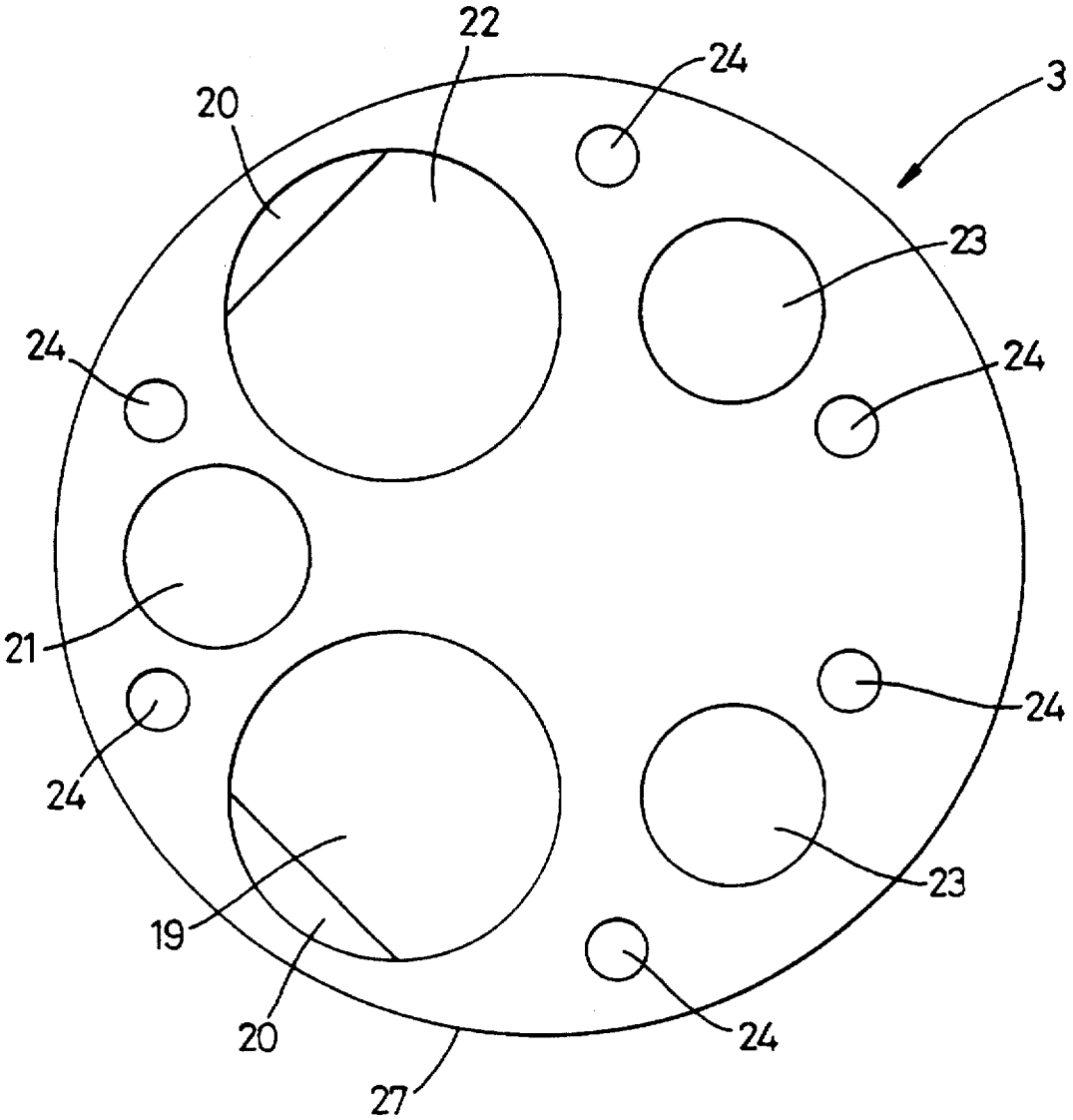
FIG. 3 is a side view of a spacer section of the assembly of FIG. 1.

FIG. 3 shows a spacer section 3 comprising a circular disc 27 having substantially flat side faces. The same reference numerals have been used in FIG. 3 for holes corresponding to those in head sections 2. The circular disc has a plurality circular holes 19, 21, 22, 23 and 24 the locations of which correspond to the holes in the head section 2 and their axes are all perpendicular to the flat faces of disc 27. The holes 19 to 24 all extending through the full thickness of disc 27.

When head sections 2, spacer sections 3 and end sections 4 and 5 are assembled as shown in FIG. 1, holes 24 (not shown in FIG. 1, but in FIGS. 2, 3 and 4) are aligned to receive stainless steel tie rods 36 with securing nuts 37 and washers 38. The axes of the tie rods are shown at 35.

The axis of the air supply connection 8 is then in alignment with the axis of the circular holes 21, and the axis of the fluid rinse/air dry nozzles 9 is in alignment with the axis of the circular holes 23.

The head sections 2 are substantially symmetrical about the axis 15 with the exception of the passageway 12. The axes of the holes 19 are aligned respectively with the slurry supply connection 6 and with the slurry return connection 7.

Figure 4:
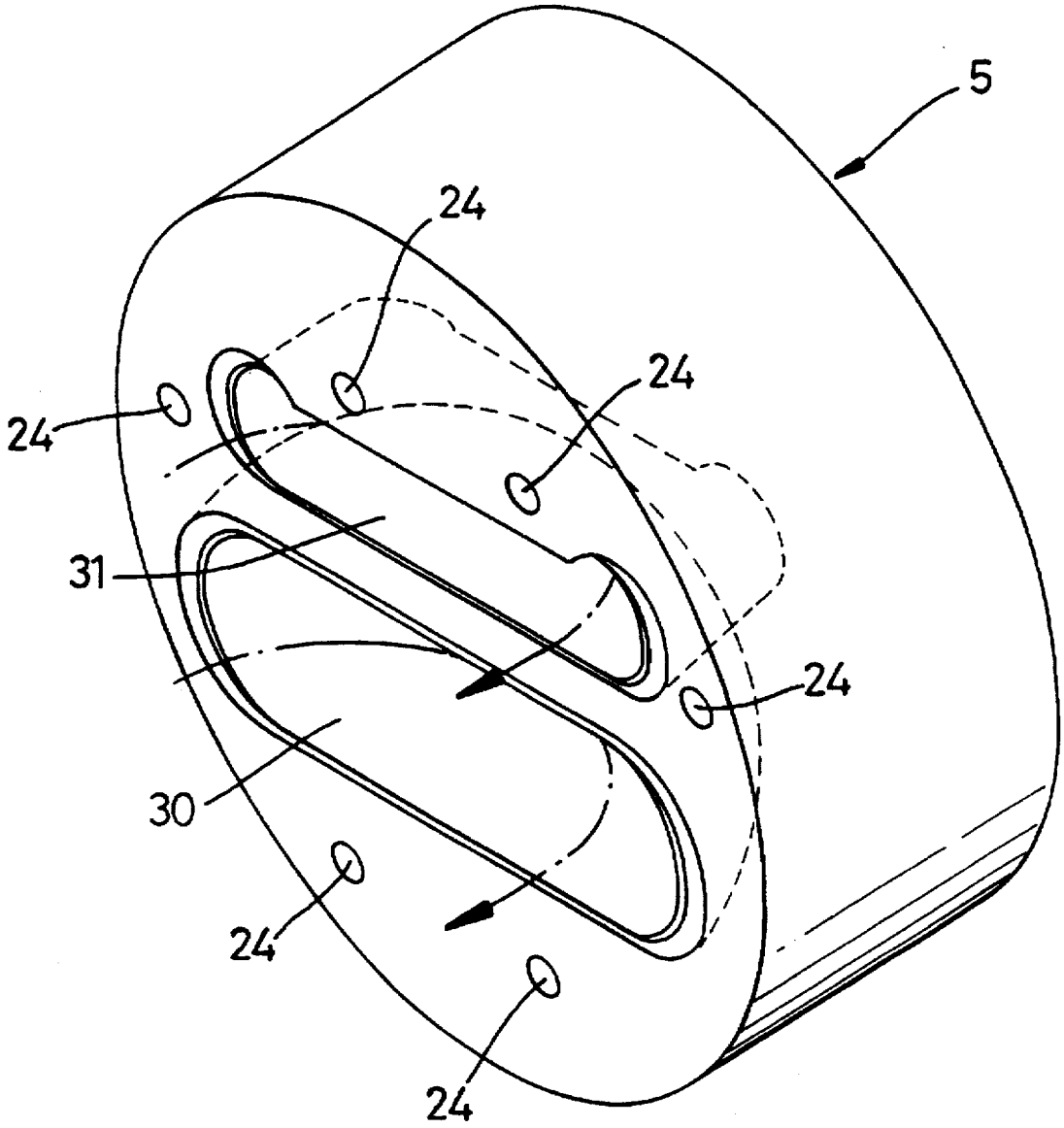
FIG. 4 is a perspective view of a return end section of the assembly of FIG. 1.

The aligned holes 19, 20, 21 and 23 form four ducts which extend for substantially the length of the blast gun assembly. As shown in FIG. 4, the return end section 5 is formed with two transverse pockets 30, 31. Pocket 30 providing for a return flow from hole 22 to hole 20 in the adjacent section 2, and optional pocket 31 connecting holes 23 in that section 2 when the holes 23 are to convey the same fluid.

It will be appreciated that it is possible to provide spacer sections 3 of different thicknesses in order to provide a different spacing of the discs 2 and accordingly of the nozzles 14.

In use the air supply connection 8 is constantly supplied with air to keep the circular holes 21 and passageways 13 pressurised. This helps to stop slurry from entering the aforementioned holes and passageways.

The outer circular shape of the blast gun helps to prevent the build-up of abrasive material on the outside of the gun, as there is a lack of flat surfaces for the material to accumulate.

Typically the assembly of FIG. 1 comprises up to about fifteen head sections 2 before the flow through the conduits connected to connections 6, 7 becomes restricting. In order to provide more head sections 2, in a modified assembly, a supply end section 4 is provided at both ends of the stack, and a special centre section is provided at the midpoint of the stack, the special centre section being provided in the opposed side faces thereof with a respective pocket similar to the pocket 30 of FIG. 4.

In a yet further modification, there are supply end sections 4 at both ends of the stack, some fluids being supplied through one of the end sections 4, whereas other fluids are supplied through the other end section 4.

I claim:

1. A blast gun assembly comprising a plurality of body sections which are clamped in face to face contact with one another, at least some of the body sections being in the form of head sections carrying respective mixture discharge nozzles, the sections being formed with duct means for supplying in use the discharge nozzles with separate flows of abrasive material and fluid, the duct means extending through the contacting faces of adjacent body sections to provide communication between said sections.

2. An assembly as claimed in claim 1, wherein the duct means contain structure operable to create fluid flow turbulence within said duct means.

3. An assembly as claimed in claim 1, wherein the duct means contain internal baffles disposed within said duct means, so as to create fluid flow turbulence within said duct means.

4. An assembly as claimed in claim 1, wherein each head section comprises an internal mixing chamber and internal passageways for introducing said separate flows of abrasive material and fluid into a common end of the said mixing chamber for subsequent discharge from the associated discharge nozzle.

5. An assembly as claimed in claim 1, comprising an alternating arrangement of head sections carrying mixture discharge nozzles, separated by sections without discharge nozzles acting as spacer sections.

6. An assembly as claimed in claim 1, wherein the sections comprise discs, and the duct means of a section comprise circular holes, the axes of which are perpendicular to the plane of each disc.

7. An assembly as claimed in claim 1, provided at one end with a supply connection and a return connection for the abrasive material.

8. An assembly as claimed in claim 7, wherein for at least some of the head sections, the ducts used for conveying abrasive material to the associated mixing chambers are in alignment with said supply connection.

9. An assembly as claimed in claim 7, wherein for at least some of the head sections, the ducts used for conveying abrasive material to the associated mixing chambers are in alignment with said return connection.

10. An assembly as claimed in claim 1, provided with at least one fluid rinse discharge.

11. An assembly as claimed in claim 1, provided with at least one air dry discharge.

12. An assembly as claimed in claim 10, wherein a head section carries said fluid rinse discharge.

13. An assembly as claimed in claim 11, wherein a head section carries said air dry discharge.

14. An assembly as claimed in claim 7, wherein the body section at the end of the assembly which is remote from said supply and return connections comprises an end body section formed with an internal pocket interconnecting said abrasive material supply and return connections.

15. An assembly as claimed in claim 7, wherein the body section at the end of the assembly which is remote from said supply and return connections comprises an end body section formed with an internal pocket interconnecting said abrasive material supply and return connections, the end of the assembly remote from said end body section having connections for the supply and return of fluid rinse and/or air drying fluids to and from the interior of the assembly and said end body section has an internal pocket interconnecting said fluid supply and return connections.

16. An assembly as claimed in claim 1, wherein at least some of the sections comprise resilient plastics material.

17. An assembly as claimed in claim 1, wherein at least some of the sections comprise urethane polymer resilient plastics material.

* * * * *